US005813192A

United States Patent [19]

White

[11] Patent Number: 5,813,192

[45] Date of Patent: Sep. 29, 1998

[54] BAG DISCHARGE DEVICE

[75] Inventor: Harold R. White, New Lenox, Ill.

[73] Assignee: ABR Corporation, New Lenox, Ill.

[21] Appl. No.: 639,730

[22] Filed: Apr. 29, 1996

[51] Int. Cl.[6] ..... B65B 43/26

[52] U.S. Cl. ..... 53/381.2; 141/114; 53/384.1; 53/492

[58] Field of Search ..... 53/492, 381.2, 53/384.1; 141/114, 65, 329, 330; 414/412, 419

[56] References Cited

U.S. PATENT DOCUMENTS

| | | | |
|---|---|---|---|
| 2,982,985 | 5/1961 | Hohenadel et al. | 414/419 |
| 3,831,504 | 8/1974 | Daly et al. | 93/93 M |
| 3,948,402 | 4/1976 | Schott, Jr. | 414/412 |
| 4,725,184 | 2/1988 | Bennison | 414/412 |
| 5,277,014 | 1/1994 | White . | |
| 5,433,577 | 7/1995 | Roycraft | 414/412 |
| 5,443,347 | 8/1995 | Weinlader | 414/412 |
| 5,484,247 | 1/1996 | Clark et al. | 414/412 |

*Primary Examiner*—John Sipos
*Assistant Examiner*—John Paradiso
*Attorney, Agent, or Firm*—Hill & Simpson

[57] ABSTRACT

An apparatus for discharging contents of a bag which includes an enclosure having a pair of pans mounted for pivotable movement therein, a bag spike associated with each pan mounted for movement along the pivot axis of the pan between a position retracted from the pan to a position impaling a bag resting on the pans, an arrangement for cutting a bag resting on the pan and an arrangement for tilting each of the pans on their axes so as to dump the contents of a bag cut by the cutting arrangement into the bottom of the enclosure, which has an arrangement for removing the contents therefrom. An advantage of this device is that all opening of the bag occurs within the enclosure to minimize contact of the contents of the bag with the operator. To remove dust and air from the substantially empty bags, flattening weights are provided above each pan in the cover and are released to flatten the bag to expel dust and air from the empty bag.

9 Claims, 5 Drawing Sheets

BAG DISCHARGE DEVICE

BACKGROUND OF THE INVENTION

The present invention is directed to an apparatus for discharging contents of bags containing flowable materials.

Flowable materials, such as dry powders and granulated materials, are used throughout the world. Such products are typically shipped and handled in bags containing 50 to 100 pounds of material. The bags are usually multi-layer bags that provide strength, moisture-resistance and protection of the product, purity and integrity. It is often the case that the materials themselves are hazardous to human health and safety, posing the risk of burning the skin and skin irritation on contact, respiratory ailments and eye irritation. Some materials are carcinogenic with long-term exposure.

The standard dump stations currently being marketed provide no more than a vented platform on which a bag is manually placed. The operator must physically slide or place the bag in the closure and cut the bag in half using a knife. He must pick up the two ends of the bag, each weighing approximately 25 pounds, and shake the contents into the hopper. The empty bags must then be stuffed by hand into a bag compactor.

The pushing, sliding, cutting, turning and shaking of the 50 pound bags or the two halves is done directly in front of a man standing upright in front of the grating, placing maximum strain on the lower back and legs. This motion can be repeated 120 times per hour, which is once every 30 seconds.

My U.S. Pat. No. 5,277,014, whose disclosure is incorporated herein by reference thereto discloses a mechanical bag discharge station in which a bag is mechanically cut and shaken to discharge the contents from the cut bag.

SUMMARY OF THE INVENTION

The object of the present invention is to provide a mechanism to mechanically open, dump and flatten bags of solids and powders in a safe, dust-free environment, which device reduces labor cost, has a minimal capital cost, and provides maximum safety with minimum lifting, handling, cutting, turning and shaking of the bags, and reduces product loss, contamination and employee exposure to dust.

Another object of the present invention is to provide an improvement over the apparatus in my U.S. Pat. No. 5,277,014, which includes a reduction in the cost of the device, and improved safety by reducing the amount of exposure of the workers to the contents of the bags being processed.

These objects are accomplished in an apparatus for discharging contents of a bag, said apparatus comprising: an enclosure having a cover hinged thereto and movable between an opened position and a closed position, said enclosure having means for removing material received in the enclosure; means for moving the cover between said positions; a pair of pans mounted in the enclosure for pivotable movement between a horizontal position, with the pans aligned to receive a bag, and a second position with the pans tilted toward the vertical position; means for pivoting the pans between said positions; a bag spike associated with each pan; means for mounting each bag spike on the enclosure for movement from a first position with the bag spike impaling a bag on the pan to a retracted position withdrawn from said pan; means for moving the spike between said positions; means for cutting a bag positioned on said pans into two parts or halves so that with the cover in the opened position, a bag can be placed on the pans, then the cover is moved to a closed position, the spikes are moved to a first position to impale the bag, which is then cut into bag parts by the means for cutting, and then the pans are pivoted to the second position to dump the contents of the bag parts, either once or repetitively. After dumping the contents of the bag parts, the spikes are withdrawn from the bag parts and the lid is lifted and the bag parts are removed. Preferably, the spikes move along the axis of rotation of the pans and the lid is provided with bag flattener means, which act to hold the bag during the step of cutting and will flatten the bag parts after the contents have been removed therefrom.

The device preferably has a control system, so that once the bag is placed on the pans and a start button is pushed, the lid is moved shut, the bag spikes are then shifted to impale the bag, the knife cuts the bag into two halves and then the knife is removed while the pans rotate rapidly from the horizontal position toward the vertical position and back and forth to shake the contents of the bag parts or halves therefrom, the spikes are retracted, flattening weights then are actuated to collapse the empty bag and expel any remaining dust and air therein, the flattening weights are then raised and the hood is opened so that the empty bag can be removed, a new bag placed on the pans and the operation repeated.

In order to prevent dust from escaping the enclosure, the interior of the enclosure is placed under a negative pressure. Thus, any leaks are directed into the enclosure and not out of the enclosure.

Other advantages and features of the invention will be readily apparent from the following description of the preferred embodiments, the drawings and claims.

DESCRIPTION OF THE PREFERRED EMBODIMENTS

Figure 1:
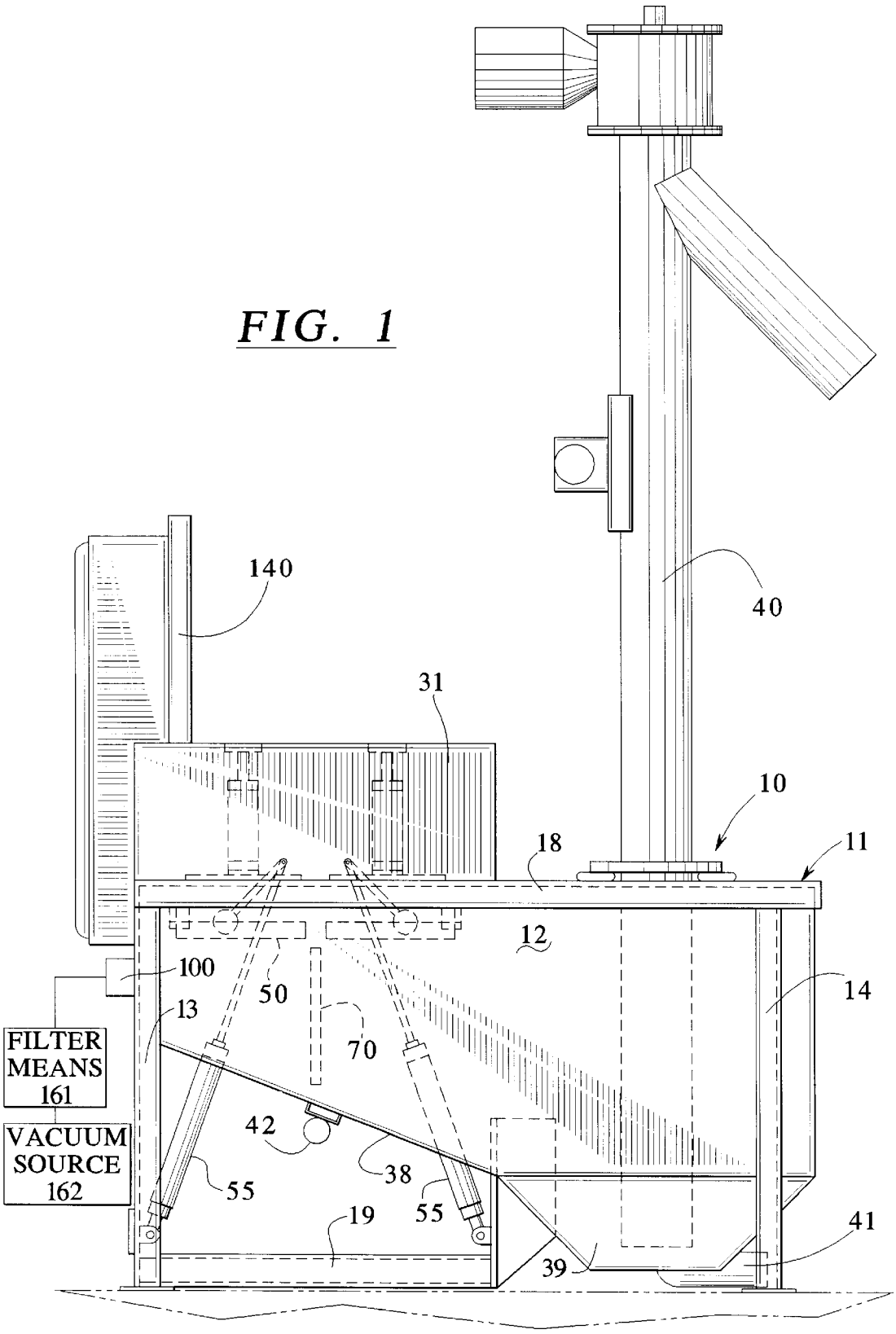
FIG. 1 is a front elevational view of a bag discharge station in accordance with the present invention.
Figure 2:
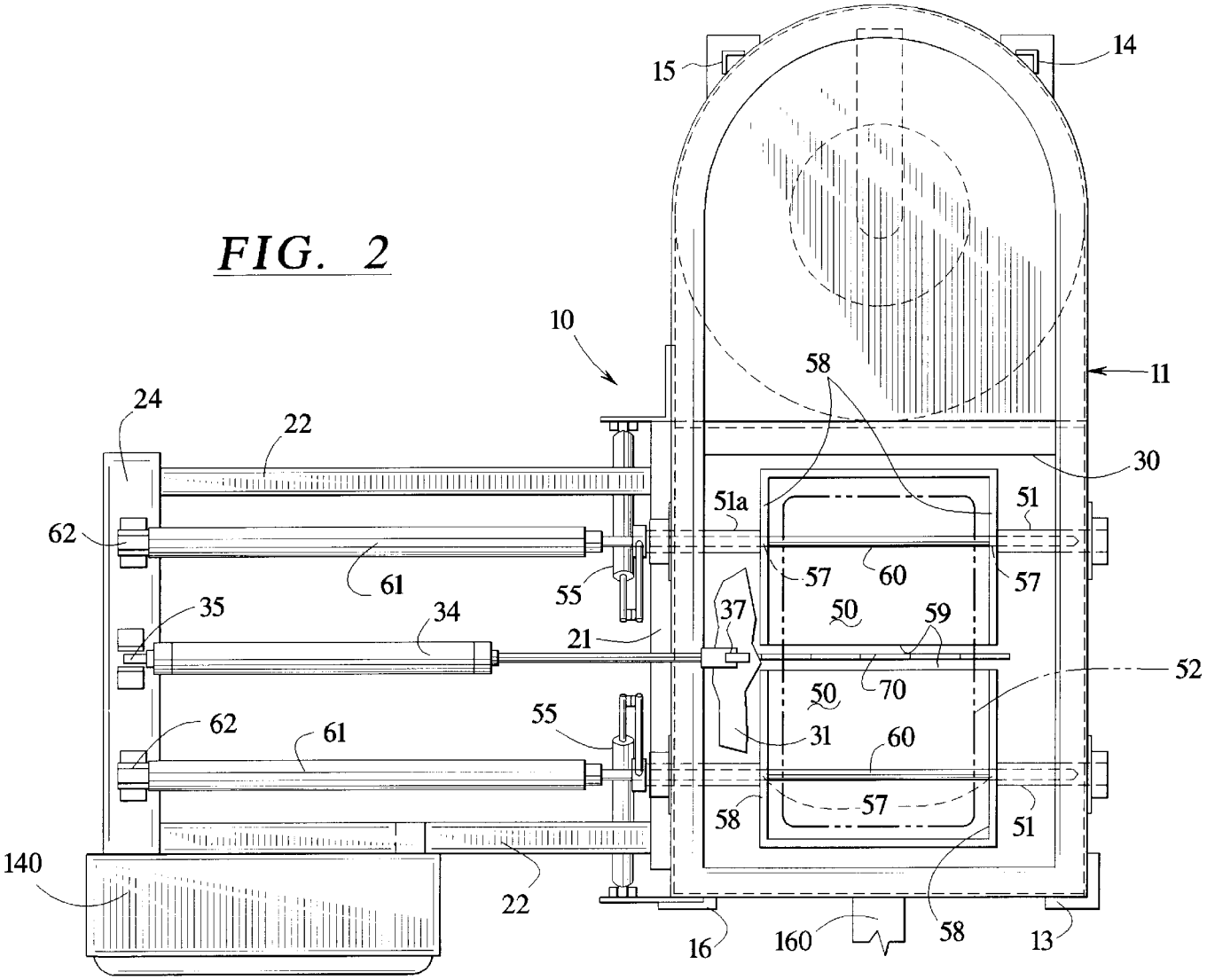
FIG. 2 is a top plan view with portions removed for purposes of illustration of the bag discharge station of FIG. 1.
Figure 3:
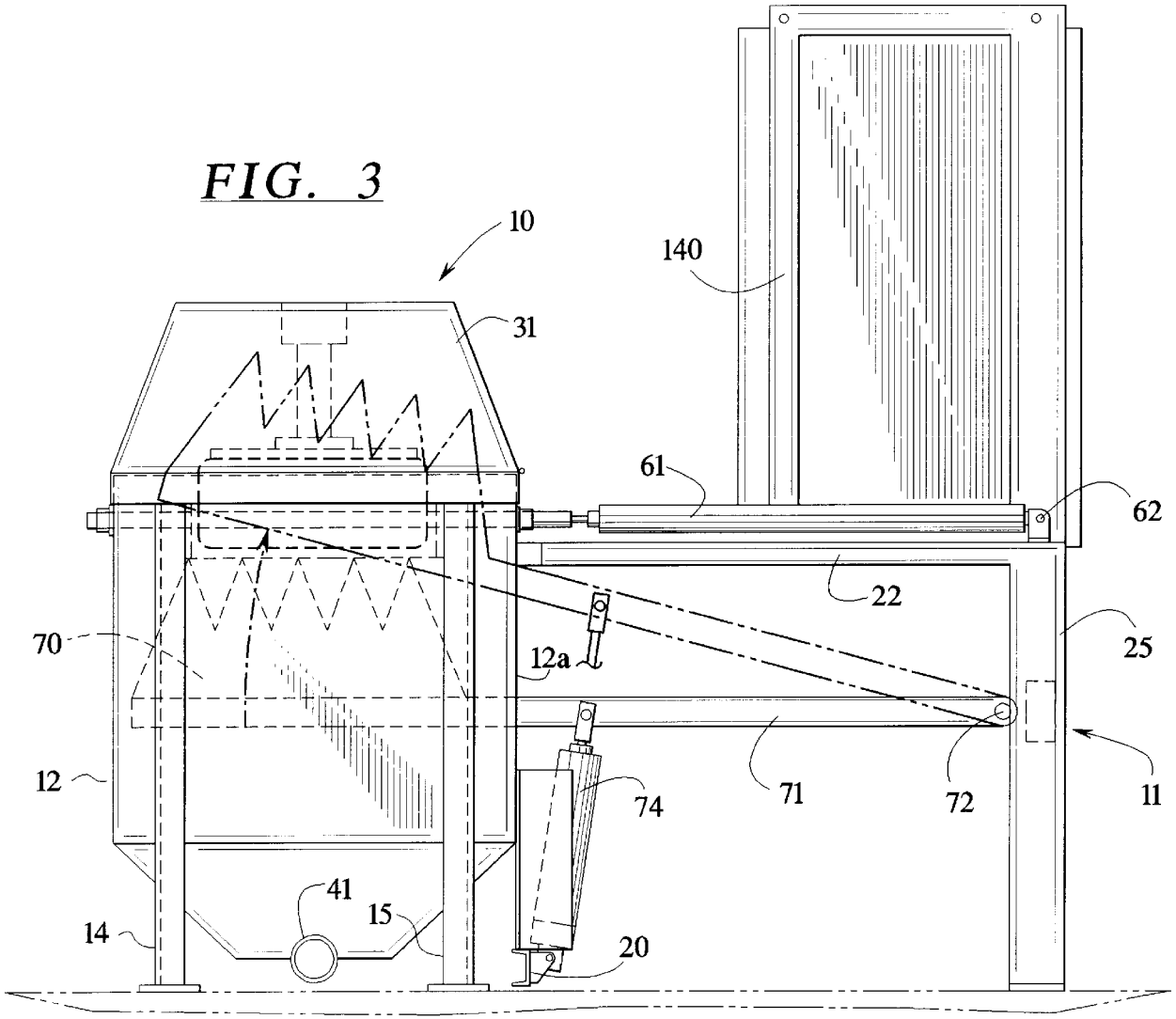
FIG. 3 is an end view taken from the right end of FIG. 1 with portions removed for purposes of illustration of the bag discharge station.

The principles of the present invention are particularly useful when incorporated in a bag discharge station, generally indicated at 10 in FIGS. 1–4. The discharge station 10 includes a frame, generally indicated at 11, which supports an enclosure 12. As shown in FIGS. 1–4, the frame 11 has a series of vertical supports 13–16, which may be formed of channel irons and are interconnected by a series of horizontal members, such as 17, 18, 19 and 20. As best illustrated in FIG. 2, extending from a member 21 are two horizontal members 22, 22, which terminate in a horizontal member 24, which is supported by a pair of legs 25 (see FIGS. 3 and 4).

Figure 4:
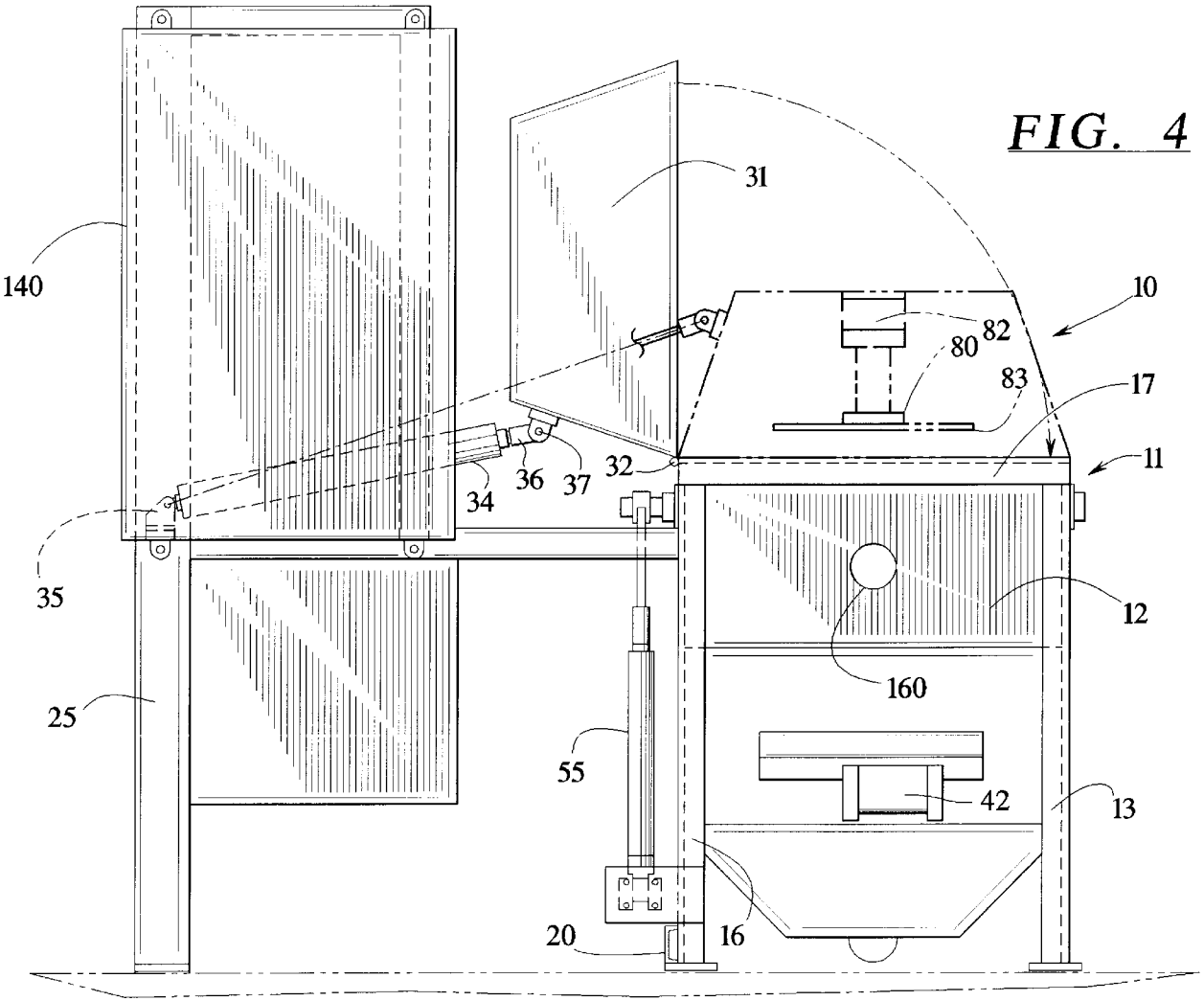
FIG. 4 is an end view taken from the left end of FIG. 1 with portions removed for purposes of illustration illustrating the opening of the container.

The enclosure 12 has an opening 30 (FIG. 2) on the top surface, which is closed by a cover 31, which has a seal and is hinged to the frame 11 by a hinge 32 (see FIG. 4). To open the cover 31, an actuator 34 has an end 35 anchored on the horizontal member 24 and a ram 36 pivotably connected at 37 to the cover 31.

As shown in FIG. 1, the enclosure 12 has a hopper-like shape with a slanting wall 38, which extends to a low point 39. Means 40 is provided for removing the contents of the enclosure and is illustrated in FIG. 1 as a vertical screw-type conveyor. It should be noted that this is just an exemplary embodiment of the type of means for removing the contents of the device. For example, a conduit can be connected to an outlet 41 to draw the contents from the well 39. To aid in the removal, a hopper vibrator 42 may be provided on the slanting wall 38.

Adjacent to the opening 30, the enclosure has a pair of pans 50, which are mounted for pivotable motion on hollow axles 51 with the pivot axis extending through openings 57 in side walls 58 of the pans 50. The pans 50 will receive a bag 52 (shown in chain lines in FIG. 2). To rotate each of the pans from a horizontal positions shown in FIG. 2 to a vertical position, actuators 55 are provided and have one end connected to the frame and the other end connected to a lever arm to each of the axles 51.

Each of the hollow axles 51 receives a bag spike 60, which is an extension of a cylinder rod for an actuator 61, which is positioned outside the enclosure and is anchored at 62 on the horizontal member 24. As illustrated, the spikes 60 can move along the pivot axis of the hollow axles 51 and through the openings 57. The spikes 60, as shown in FIG. 2, have an extended position, which has the spike impale the bag 52 disposed on the two pans 50. In the retracted position, each of the spikes 60 is withdrawn into the cylinders of the actuator 61 and would be withdrawn into the portion 51 a of each of the axles 51 so that a bag could be removed.

To cut a bag 52 disposed on the pans 50, cutting means comprising a serrated cutting blade or knife 70 is mounted on an arm 71. The arm 71 is pivotably mounted at 72 on a horizontal portion extending between the legs 25 and is movable in a slot in a rear wall 12*a* of the enclosure 12, which slot is provided with sealing strips or sealing brushes that form a seal around the arm but allow the arm to move in the slot. To pivot the arm 71 between the position illustrated in FIG. 3 in bold lines and a raised position in chain lines, an actuator 74 is provided. The actuator is mounted on the frame members, such as to a horizontal member 20. The blade 70 moves in a vertical plane between the opened ends 59 of the pans 20 so as to cut a bag 52 disposed on the pans substantially into two halves.

To hold the bag on the pan while it is being cut, a bag flattener 80 is provided for each pan. These flatteners are mounted in the lid 31 and include a plate 83 connected to an actuator 82, which is a single-acting actuation, to raise the plate 83. The weight of the plate 83 is used to press the plate 83 against the bag to hold it during the cutting operation and to flatten the bag to expel any dust and air therein subsequent to the emptying operation. However, a double-acing actuator could also be used to apply additional pressure on the bag.

Preferably, the actuators 34, 55, 61, 74 and 82 are pneumatic actuators. However, all of the actuators or some may be replaced by electro-mechanical actuators or hydraulic actuators or combinations of electro-mechanical and hydraulic actuators.

To prevent dust from leaking out of the hopper or enclosure, the interior of the enclosure is placed under a negative pressure. As illustrated in FIG. 1, this is accomplished by a duct 160 extending through an air filter means 161 to a vacuum source 162. The filter means 161 can be a conventional device for removing dust from a flow of air.

Figure 5:
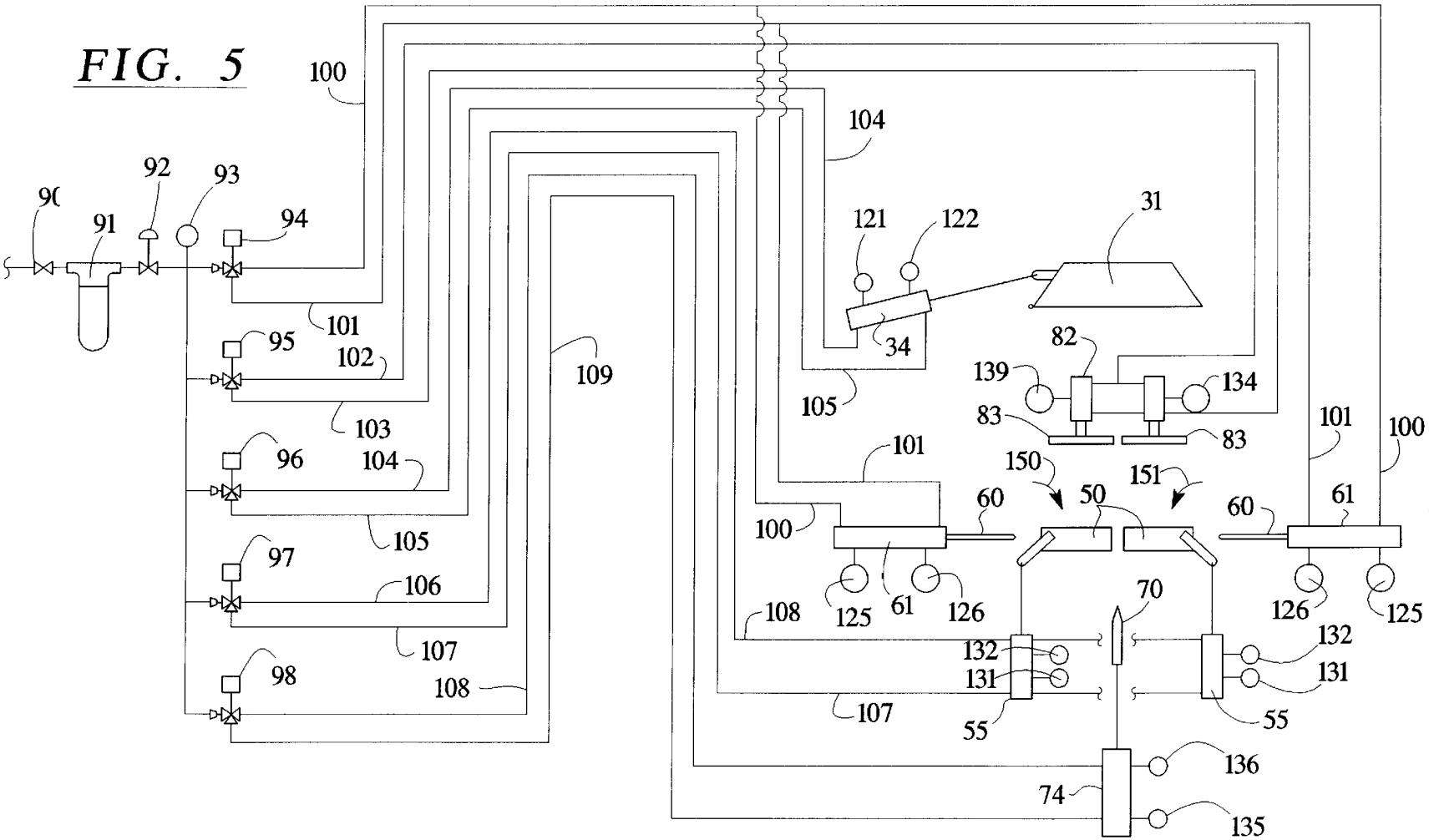
FIG. 5 is a diagram of the pneumatic control system for the various actuators of the device.

In FIG. 5, a diagram for the pneumatic operation of the various actuators is illustrated. Air under pressure enters through a valve 90, passes through an airline filter 91, a pressure regulator 92 where the pressure is indicated on a gauge 93. From the regulator 92, the air is conducted to five solenoid valves 94–98, which are connected in parallel. The solenoid valve 94 is connected by lines 100 and 101 to the two actuators 61, 61 for the bag spikes. The solenoid valve 95 controls air to lines 102, 103 that extend to the actuators 82, 82 for the bag flatteners. The solenoid valve 96 controls air in lines 104 and 105 extending to actuators 34 for the lid or cover 31. The solenoid valve 97 controls flow of air in the lines 106 and 107 to the actuators 55, 55, which rotate the pans 50. The solenoid 98 controls the flow of air in lines 108 and 109 to the actuator 79 for the cutting knife 70.

The actuator 34 has two limit switches, with the limit switch 121 determining the retracted position of the ram, which would have the lid 31 in the open position, while a limit switch 122 determines the extended position of the ram, which has the lid closing the opening 30. In a similar way, each of the actuators 61 has a limit switch 125 to determine when the actuators are in the retracted position and a limit switch 126 to detect the extended position with the spike impaling the bag. Each of the actuators 55 have a limit switch 131, which indicates a retracted position, and a limit switch 132, which indicates the extended position. The actuator 74 has a limit switch 135 showing a retracted position and a limit switch 136 for the extended position, and each of the actuators 82 has a limit switch 139 showing the retracted position. These solenoid valves can be located in a control box 140 which is on one of the members 22. The control box 140 also contains conventional control means for sequencing the operation of the valves in a program in response to detected conditions.

With the operation, the operator begins by turning on the air supply and power to the unit. The knife is in the retracted position, which is indicated by the limit switch 135. Each of the bag spikes are in the retracted position, which is indicated by the limit switches 125. Each of the flatteners are in the raised position, as indicated by the limit switches 139. The pans are rotated to a horizontal position, which is indicated by the limit switches 131. Finally, the hood is moved to an open position, which is indicated by the limit switch 121. The operator now places a bag on the pans 50 and presses the start button on a control box to start the operation. With the start of the operation, the solenoid valve 96 shifts to a position so as to cause the actuator to move to the extended position to close the lid 31, which extended position is indicated by the limit switch 122. With the hood in the closed position, the solenoid valve 94 operates to apply pressure in the line 100 to move each of the actuators 61 to the extended position to impale the bag by the spikes 60 when in the extended position, which is indicated by the limit switch 126. During this time, the solenoid valve 95 may be actuated to release the actuators 82 so that the weight of the plate 83 of the flattening means 80 will fall onto the bag. After the impaling of the bag by the spikes 60, the solenoid valve 98 is actuated to apply a pressure in line 109 to raise the cutting blade 70 to a cutting position, which will be indicated by the limit switch 136. After raising the cutting blade to that position to cut the bag in half, the solenoid valve 98 is shifted to apply pressure in line 108 and vent line 109, so that the knife will be lowered to the retracted position, which is indicated by the limit switch 135. Also, at the same time, the solenoid valve 95 is actuated to apply pressure in the lines 102 to cause the actuators 82 to raise the plate or weights 83 to a raised position, which is indicated by the limit switches 139.

While in this condition, with the knife lowered and the weights raised, the solenoid valve 97 is actuated to apply pressure in lines 107 to extend the rams of the actuators 55 to cause each of the pans 50 to rotate in the direction of arrows 150 and 151 to dump the contents in each half of the bags located in each of the pans. When they are rotated down to substantially the vertical position, the limit switch 132 will indicate the extended position and cause the valve 97 to apply pressure in the lines 106 and vent lines 107 so as to rotate from the vertical position back to the horizontal position. This is repeated three times. After completing this, the valve 94 applies air in line 101 and vents 100 to cause each of the actuators 61 to move to the retracted position to withdraw the spikes 60, the valve 95 is actuated to cause each of the actuators 82 to release the weights 83 so that they can drop onto the empty bags to expel any remaining dust and air, then the flattening weights 83 are raised by the solenoid valve 95 applying air to move the actuators 82 to the retracted position, the hood is then raised by the valve 96 applying air in the line 105 to move the actuator 35 to the retracted position, which will be indicated by the limit switch 121. With the hood raised, the operator can remove the empty, flattened bag and place it in a compactor and repeat the operation by placing a new bag on the horizontal pans 50 for the next operation.

In addition to the limit switches, interlocks are provided. These include a hood interlock, which prevents the opening of the hood unless the knife blade is in the lower position, the bag spikes are in the retracted position and the pans are in the horizontal position. A knife blade interlock prevents the raising of the knife blade unless the hood is closed. A bag spike interlock prevents the bag spikes from being extended unless the hood is in the closed position. Finally, the hood closing interlock requires that the two push buttons, which are wired in series, be actuated to close the hood so that the operator is required to use both hands. If either button is released before the hood is closed, the hood will automatically reopen. It is also possible to provide optional safety equipment, such as a passive infrared detector, which will scan the area above the bag pans and prevent the hood from closing unless the area is clear. If this detector senses presence while the hood is closing, the hood will stop and return to the open position.

Advantages of the present device over that of the device of my U.S. Pat. No. 5,277,014 are that a single enclosure with a hinged lid or cover provides complete access to the pans, the pans are stationary and are mounted only for rotation between the horizontal and the vertical position within the closure, the bag spikes move in and out horizontally through the pivot points of the pans, the bag flatteners serve the dual purpose of holding the bags down during the cutting step and flattening the bags after they have been emptied, and the final compacting of the bag is done in a separate piece of equipment. These differences enable reducing the mechanism required in the device of the patent and provide the advantage that the bag is completely within the enclosure when the bag spike penetrates the sides of the bag to reduce contact of personnel with the contents of the bag.

Although various minor modifications may be suggested by those versed in the art, it should be understood that I wish to embody within the scope of the patent granted hereon all such modifications as reasonably and properly come within the scope of my contribution to the art.

I claim:

1. An apparatus for discharging contents of a bag, said apparatus comprising:

an enclosure having a horizontal opening, said enclosure having a cover hinged to a side of the opening and movable between an opened position and a position closing the opening, said enclosure having conveyor means for removing material received in the enclosure;

means for moving the cover between said positions;

a pair of pans mounted in the enclosure adjacent the opening for pivotable movement between a horizontal position with the pans aligned to receive a bag and a second position with the pans tilted toward a vertical position;

means for pivoting the pans between said positions;

a bag spike associated with each pan;

means for mounting said bag spike on the enclosure for movement from a first position with the spike impaling a bag on the pan to a retracted position withdrawn from said pan;

means for moving the spike between said position;

means for cutting a bag positioned on said pans; and a bag flattener being mounted above each pan, each bag flattener including a weight and an actuator for lifting the weight to a retracted position and releasing the weight to fall onto a bag to aid in holding the bag during impaling and cutting and to flatten the empty bag after discharging the contents of the bag so that a bag placed on the pans can be impaled, cut and than emptied while completely enclosed in the enclosure.

2. An apparatus according to claim 1, wherein each pan of the pair of pans is mounted by a hollow tubular axle for pivotable movement in the enclosure, and the means for mounting each bag spike mounts the bag spike for movement in the hollow axle so that the spike impales the bag on the pivot axis for the pan.

3. An apparatus according to claim 1, which includes means to create a negative pressure within the enclosure.

4. An apparatus according to claim 1, wherein the means for cutting a bag includes an actuator, the means for moving the cover includes an actuator, the means for pivoting the pan includes a pair of actuators, the means for moving each spike includes an actuator, said actuators being electromechanical actuators.

5. An apparatus according to claim 1, wherein the means for cutting a bag includes an actuator, the means for moving the cover includes an actuator, the means for pivoting the pans includes a pair of actuators, the means for moving each spike includes an actuator, said actuators being hydraulic actuators.

6. An apparatus according to claim 1 wherein the means for cutting a bag includes an actuator, the means for moving the cover includes an actuator, the means for pivoting the pans includes a pair of actuators, the means for moving each spike includes an actuator, said actuators being pneumatic actuators connected to a source of pressurized air by the solenoid, and said apparatus includes control means for actuating the valves in a sequence so that the lid is closed, then the spikes are moved to impale a bag on the pans, the impaled bag is cut into two parts by the means for cutting and then the parts are empty by pivoting the pans.

7. An apparatus according to claim 6, wherein each of the pans is mounted on a hollow axle extending through a wall of the pan, each spike being mounted for movement in the hollow axle through the side walls of the pan so that the spike impales the bag in the pan on the pivot axis for the pan.

8. An apparatus according to claim 1, where each bag flattener is mounted on the cover.

9. An apparatus for discharging contents of a bag, said apparatus comprising:

an enclosure having an opening and a cover movable between a first position removed from the opening and a second position closing the opening, said enclosure having conveyor means for removing material received in the enclosure;

means for moving the cover between said positions;

a pair of pans being mounted in the enclosure adjacent the opening for pivotable movement between a horizontal position with the pans aligned to receive a bag passing through the opening and a second position with the pans tilted toward a vertical position;

means for pivoting the pans between said positions;

a bag spike associated with each pan;

means for mounting each bag spike in the enclosure for movement from a first position with the spike impaling a bag on the pan to a retracted position withdrawn from said pan;

means for moving the spike between said positions;

means for cutting a bag positioned on said pans; and a bag flattener being mounted above each pan, each bag flattener including a weight and an actuator for lifting the weight to a retracted position from a release position resting on a bag on the pan so that a bag on the pans can be impaled, cut and then emptied while entirely within the enclosure.

* * * * *